US011607023B2

(12) United States Patent
Chang et al.

(10) Patent No.: US 11,607,023 B2
(45) Date of Patent: Mar. 21, 2023

(54) HAIR DRYER

(71) Applicant: ORIENTAL SYSTEM TECHNOLOGY INC., Hsinchu (TW)

(72) Inventors: Teng-Wen Chang, Hsinchu (TW); Yu-Te Chen, Hsinchu (TW); Po-Tzu Chen, Hsinchu (TW); Yi-Chou Huang, Hsinchu (TW)

(73) Assignee: ORIENTAL SYSTEM TECHNOLOGY INC., Hsinchu (TW)

( * ) Notice: Subject to any disclaimer, the term of this patent is extended or adjusted under 35 U.S.C. 154(b) by 596 days.

(21) Appl. No.: 16/726,602

(22) Filed: Dec. 24, 2019

(65) Prior Publication Data

US 2021/0153620 A1 May 27, 2021

(30) Foreign Application Priority Data

Nov. 21, 2019 (CN) ..... 201911148449.1

(51) Int. Cl.
*A45D 20/12* (2006.01)

(52) U.S. Cl.
CPC ..... *A45D 20/12* (2013.01)

(58) Field of Classification Search
CPC ..... A45D 20/12; A45D 20/122; A45D 7/02; A45D 7/06
See application file for complete search history.

(56) References Cited

U.S. PATENT DOCUMENTS 4,424,437 A * 1/1984 Walter ..... A45D 20/12 392/383
5,636,318 A * 6/1997 Polaert ..... F24H 9/2071 34/283
6,026,821 A * 2/2000 Last ..... A45D 20/12 132/211
10,470,545 B2 * 11/2019 Thiebaut ..... A46B 15/0006
2006/0215728 A1 * 9/2006 Jang ..... G01J 5/02 374/121
2021/0307479 A1 * 10/2021 Conrad ..... A45D 20/122

* cited by examiner

*Primary Examiner* — Gregory A Wilson
(74) *Attorney, Agent, or Firm* — Muncy, Geissler, Olds & Lowe, P.C.

(57) ABSTRACT

A hair dryer comprises a fan, a heater, a temperature sensor, and a controller. The heater is disposed at the airflow output end of the fan and used to heat the airflow output by the fan. The temperature sensor is pointed to the hair, receiving the infrared light radiated by the hair to obtain the temperature of the hair, determining the dryness of the hair according to at least one of the temperature of the hair and the rate of temperature variation of the hair, and outputting a corresponding control signal. The controller is electrically connected with the fan, the heater and the temperature sensor, and controlling at least one of the rotation speed of the fan and the heating power of the heater according to the control signal. The above-mentioned hair dryer not only can prevent from hair overheating and hair damage but also can shorten the time for drying hair.

13 Claims, 3 Drawing Sheets

HAIR DRYER

BACKGROUND OF THE INVENTION

1. Field of the Invention

The present invention relates to a hair dryer, particularly to a hair dryer able to detect the temperature of hair.

2. Description of the Prior Art

A hair dryer generates hot airflow to blow the hair of the user to evaporate the moisture on the hair and thus dry the hair. It is easily understood: a higher temperature and a larger flowrate of the hot airflow can dry hair faster. After the moisture of the hair is decreased, the hot air airflow with a higher temperature and a larger flowrate is likely to overheat and damage the hair, however.

The conventional hair dryer controls the hot airflow to a lower temperature, such as a temperature of 50-60° C., to prevent from overheating and damaging the hair. Although the airflow is controlled to a lower temperature, heat may be accumulated on the hair, and the temperature of the hair may be raised by blowing the hair for a longer time. Besides, blowing the hair with an airflow of a lower temperature will prolong the time for drying hair.

Accordingly, a hair dryer able to avoid overheating hair and shorten the time for drying hair becomes a target the manufacturers are eager to achieve.

SUMMARY OF THE INVENTION

The present invention provides a hair dryer, which uses a non-contact temperature sensor to detect the temperature of hair and determines the dryness of the hair according to at least one of the temperature of the hair and the rate of temperature variation of the hair, whereby the hair dryer of the present invention can automatically adjust the temperature or flowrate of the hot airflow, wherefore the hair dryer of the present invention not only can protect hair from being overheated or damaged but also can shorten the time for drying hair.

In one embodiment, the hair dryer of the present invention comprises a fan, a heater, a temperature sensor, and a controller. The fan generates an airflow to blow the hair of the user along an airflow output direction. The heater is disposed at the airflow output end of the fan, used to heat the airflow generated by the fan. The temperature sensor includes an infrared sensor and a signal processor. The infrared sensor is pointed to the hair of the user, receiving an infrared light radiated by the hair, and outputting a sensation signal. The signal processor is electrically connected with the infrared sensor, used to process the sensation signal to acquire the temperature of the hair, determining the dryness of the hair according to at least one of the temperature of the hair and the rate of temperature variation of the hair, and then outputting a control signal. The controller is electrically connected with the fan, the heater and the temperature sensor, controlling at least one of the rotation speed of the fan and the heating power of the heater according to the control signal.

Below, embodiments are described in detail in cooperation with the attached drawings to make easily understood the objectives, technical contents, characteristics and accomplishments of the present invention.

BRIEF DESCRIPTION OF THE DRAWINGS

The foregoing conceptions and their accompanying advantages of this invention will become more readily appreciated after being better understood by referring to the following detailed description, in conjunction with the accompanying drawings, wherein.

DESCRIPTION OF THE PREFERRED EMBODIMENTS

Figure 1:
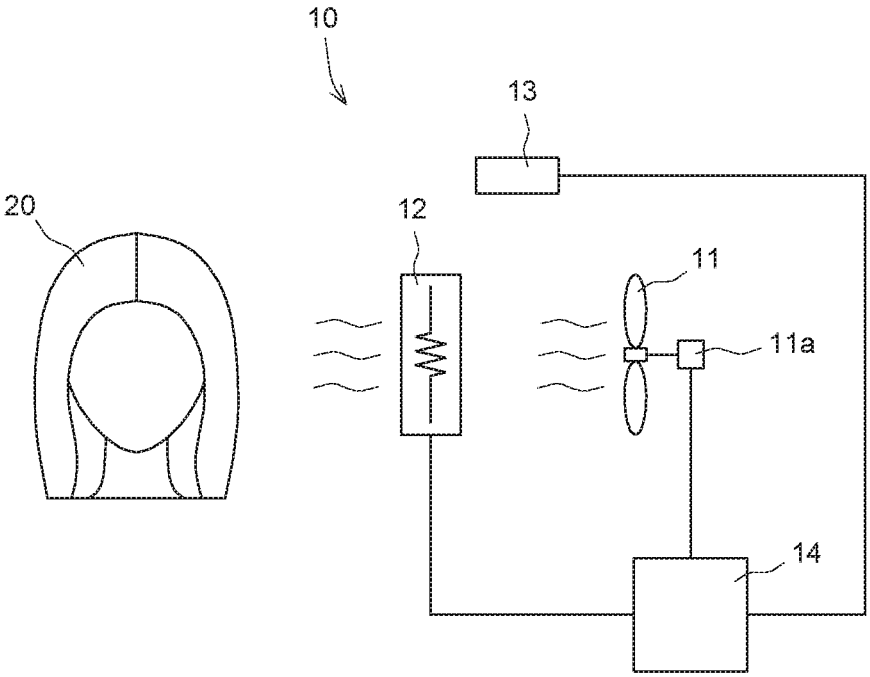
FIG. 1 is a diagram schematically showing a hair dryer according to one embodiment of the present invention.

The present invention will be described in detail with embodiments and attached drawings below. However, these embodiments are only to exemplify the present invention but not to limit the scope of the present invention. In addition to the embodiments described in the specification, the present invention also applies to other embodiments. Further, any modification, variation, or substitution, which can be easily made by the persons skilled in that art according to the embodiment of the present invention, is to be also included within the scope of the present invention, which is based on the claims stated below. Although many special details are provided herein to make the readers more fully understand the present invention, the present invention can still be practiced under a condition that these special details are partially or completely omitted. Besides, the elements or steps, which are well known by the persons skilled in the art, are not described herein lest the present invention be limited unnecessarily. Similar or identical elements are denoted with similar or identical symbols in the drawings. It should be noted: the drawings are only to depict the present invention schematically but not to show the real dimensions or quantities of the present invention. Besides, matterless details are not necessarily depicted in the drawings to achieve conciseness of the drawings.

Figure 2:
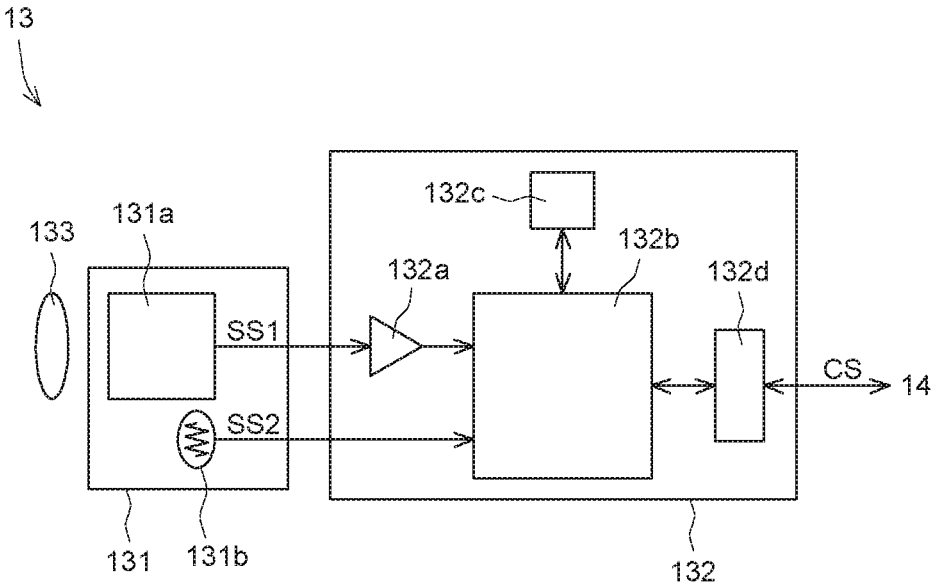
FIG. 2 is a diagram schematically showing a temperature sensor of a hair dryer according to one embodiment of the present invention.

Refer to FIG. 1. In one embodiment, the hair dryer 10 of the present invention comprises a fan 11, a heater 12, a temperature sensor 13, and a controller 14. The fan 11 generates an airflow to blow the hair of the user along an airflow output direction. In one embodiment, the fan 11 includes a motor 11*a*; the motor 11*a* rotates the fan 11, and the rotating fan 11 further drives the airflow to blow along the airflow output direction. The heater 12 is disposed at an airflow output end of the fan 11. The airflow generated by the fan 11 passes through the heater 12 for heat exchange, whereby the airflow is heated in the heater 12. The temperature sensor 13 is pointed to the hair of a user 20 to detect the temperature of the hair of the user 20, determining the dryness of the hair according to at least one of the temperature of the hair and the rate of temperature variation of the hair, and then outputting a corresponding control signal CS (as shown in FIG. 2). The rate of temperature variation is expressed by the following equation:

$$\text{Temp variation rate} = \frac{\text{Temp1} - \text{Temp2}}{\text{Time interval between two measurements}}$$

Wherein Temp1 is the temperature in the current measurement, and Temp2 is the temperature in the preceding measurement.

The controller 14 is electrically connected with the fan 11, the heater 12 and the temperature sensor 13, controlling at least one of the rotation speed of the fan 11 and the heating power of the heater 12 according to the corresponding control signal CS, i.e. adjusting the flowrate and/or the temperature of the hot airflow.

Refer to FIG. 2. In one embodiment, the temperature sensor 13 includes an infrared sensor 131 and a signal processor 132. The infrared sensor 131 further includes an infrared sensing element 131*a* and a thermistor 131*b*. The infrared sensing element 131*a* is pointed to the hair of the user 20, receiving the infrared light radiated by the hair, and outputting a sensation signal SS1. The thermistor 131*b* senses the ambient temperature and outputs a sensation signal SS2 to compensate for the infrared sensing element 131*a*, whereby a more accurate sensation result is acquired.

In one embodiment, the temperature sensor 13 further includes a lens 133, which is disposed at a receiving side of the infrared sensor 131, such as the sensing face of the infrared sensing element 131*a*. For example, the focal length of the lens 133 and the size of the infrared sensing element 131*a* determine the measurement area of the infrared sensor 131, i.e. the viewing angle for receiving the infrared light by the infrared sensor 131. It is easily understood: the material of the lens 133 must be an infrared-transmission material, such as silicon, germanium, sapphire, or zinc selenide, which allows the infrared light with a wavelength of 1-14 μm to pass through. In one embodiment, the lens 133 is a siliceous Fresnel lens. In one embodiment, the infrared sensor 131 senses the infrared light with a wavelength of 5-14 μm, which is corresponding to the infrared radiation of water and human bodies.

The signal processor 132 is electrically connected with the infrared sensor 131, processing the sensation signals SS1 and SS2, which are output by the infrared sensor 131, to obtain the temperature of the hair. The signal processor 132 may determine the dryness of the hair according to the temperature of the hair and/or the rate of temperature variation of the hair and then outputs the corresponding control signal CS.

In one embodiment, the signal processor 132 further includes a signal amplifier 132*a*, a microcontroller 132*b*, a non-volatile memory 132*c* and a communication interface 132*d*. The infrared sensing element 131*a* outputs the sensation signal SS1 to the signal amplifier 132*a*. The microcontroller 132*b* receives the amplified sensation signal SS1; the built-in analog-to-digital converter of the microcontroller 132*b* converts the sensation signal SS1, which is output by the infrared sensing element 131*a*, into a digital signal. Similarly, the resistance of the thermistor 131*b* is also converted into a digital signal by the built-in analog-to-digital converter of the microcontroller 132*b*, whereby the ambient temperature is learned. The non-volatile memory 132*c* stores a calibration parameter of the infrared sensing element 131*a* and/or a parameter of the thermistor 131*b*, which are used to calculate the value of the detected temperature. The non-volatile memory 132*c* may also store the instructions for executing a judgement method. The microcontroller 132*b* may download the instructions to determine the dryness of the hair. The communication interface 132*d* is used to transmit the control signal CS to the controller 14. The communication interface 132*d* may be an Inter-Integrated Circuit Bus (I2C), a Universal Asynchronous Receiver/Transmitter (UART), a Serial Peripheral Interface (SPI), or a Universal Serial Bus (USB), which is an interface for analog voltage outputs or logic IO outputs. It is easily understood: the non-volatile memory 132*c* and the communication interface 132*d* may be integrated with the microcontroller 132*b*, such as the microcontroller STM8L151G6U6.

Figure 3:
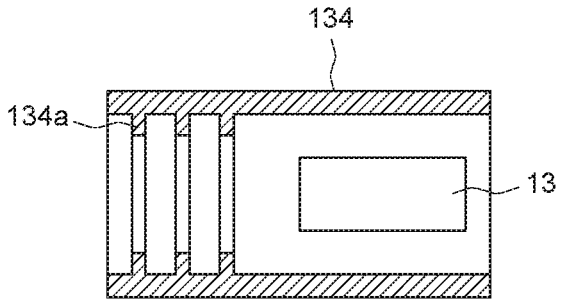
FIG. 3 is a diagram schematically showing a temperature sensor of a hair dryer according to another embodiment of the present invention.
Figure 4:
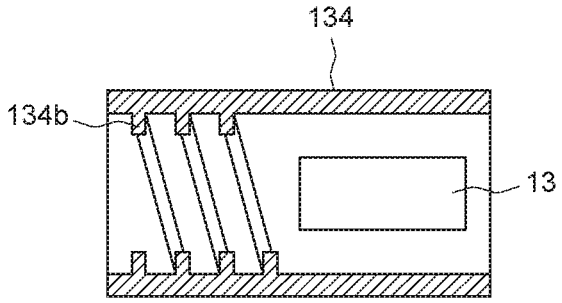
FIG. 4 is a diagram schematically showing a temperature sensor of a hair dryer according to still another embodiment of the present invention.

Refer to FIG. 3. In one embodiment, the temperature sensor 13 is disposed inside a sleeve 134. The sleeve 134 can shield the temperature sensor 13 from external stray infrared light, whereby the variation of the distance between the temperature sensor 13 and the detected object (i.e. the hair) would not affect the accuracy of temperature measurement. In other words, the ratio of the measurement distance between the temperature sensor 13 and the detected object to the measurement area is increased. In one embodiment, the inner wall of the sleeve 134 is blackened to reduce the reflection of the stray infrared light inside the sleeve 134 and thus decrease the error of temperature measurement. In one embodiment, the inner wall of the sleeve 134 is treated with anodizing. In one embodiment, the inner wall of the sleeve 134 has a plurality of ring-shape protrusions 134*a*, as shown in FIG. 3. Alternatively, the inner wall of the sleeve 134 has a screw thread 134*b*, as shown in FIG. 4. The ring-shape protrusions 134*a* and the screw thread 134*b* can also reduce the reflection of the stray infrared light inside the sleeve 134 and thus decrease the error of temperature measurement.

Figure 5:
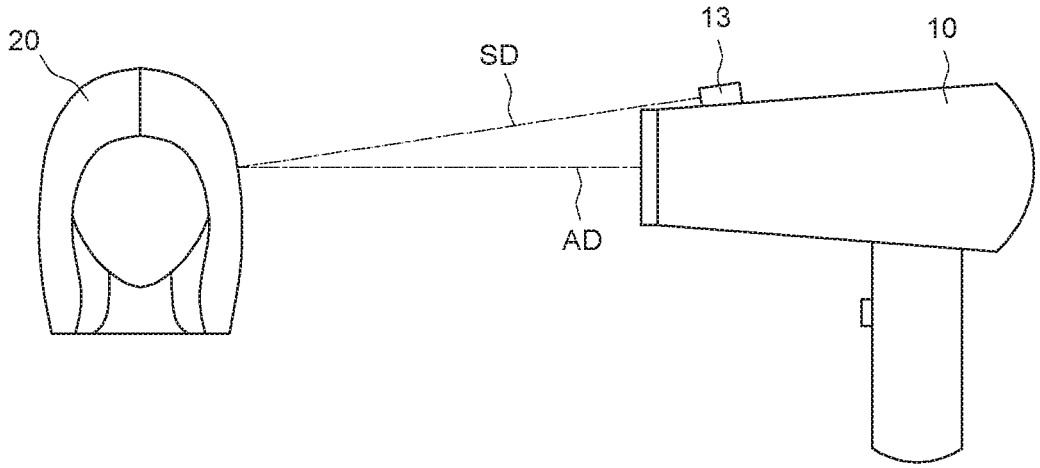
FIG. 5 is a diagram schematically showing a hair dryer according to yet another embodiment of the present invention.

Refer to FIG. 5. In one embodiment, the sensation direction SD of the temperature sensor 13 is skew to the airflow output direction AD of the hair dryer 10 and intersects with the airflow output direction AD of the hair dryer 10. It is easily understood: the area blown by the hot airflow of the hair dryer 10 is exactly the area whose temperature needs to be detected by the temperature sensor 13. It is the common usage habit of a hair dryer: the airflow output opening of a hair dryer 10 is kept 5-20 cm away from the hair. Therefore, the position where the sensation direction SD of the temperature sensor 13 intersects with the airflow output direction AD of the hair dryer 10 is designed to be κ-20 cm away from the airflow output opening of the hair dryer 10.

Figure 6:
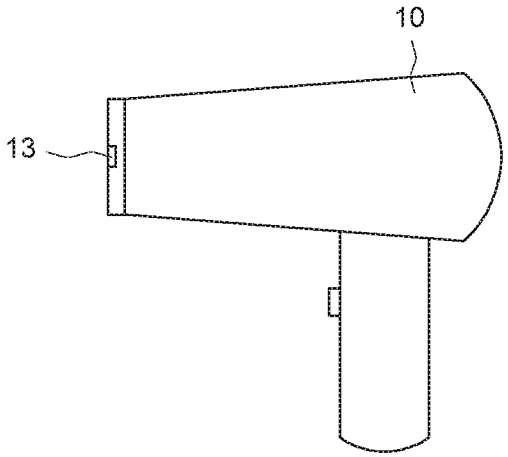
FIG. 6 is a diagram schematically showing a hair dryer according to a further embodiment of the present invention.

Refer to FIG. 6. In one embodiment, the sensation direction SD of the temperature sensor 13 is parallel to the airflow output direction AD of the hair dryer 10. For example, the temperature sensor 13 is disposed at the geometrical center of the airflow output opening of the hair dryer 10. In such a case, the sensation direction SD of the temperature sensor 13 is aimed at the center of the area blown by the hot airflow of the hair dryer 10, which is normally an area having higher temperature.

Refer to Table. 1, which shows different operation modes of the hair dryer of the present invention. According to the drying curve, the hair contains more water in the early stage of drying. In the early stage of drying, heat is carried out while water is evaporated, and the temperature of the hair will not increase obviously. If the user selects the fast-drying mode, the hair dryer of the present invention outputs a hot airflow having a higher temperature, and the temperature sensor 13 periodically detects the temperature of the hair at the same time. For example, the temperature sensor 13 detects the temperature of the hair once per second, i.e. At is one second.

TABLE 1

| Operation mode | Upper-limit threshold of hair temp | Interval between two succeeding measurements | Threshold of temp variation rate | Index of hair wetness |
|---|---|---|---|---|
| Fast-drying mode | T | Δt | — | — |
| Hair end-smoothing mode | T1 | Δt1 | C1 | M1 |
| Hair-maintaining mode | T2 | Δt2 | C2 | M2 |

While the temperature of the hair is equal to or larger than an upper-limit threshold T, such as 55° C., it indicates that the hair within the measurement area of the temperature sensor 13 has been dried to a certain extent and that the temperature of the hair begins to rise. At this moment, the controller 14 may lower the heating power of the heater 12 to decrease the temperature of the output hot airflow or remind the user to stop the operation of the hair dryer. In one embodiment, the controller 14 may increase the rotation speed of the fan 11, i.e. increase the flowrate, to decrease the temperature of the hair. While the hair dryer is moved to the area of undried hair or the temperature of the hair decreases, which makes the temperature sensor 13 detect a hair temperature equal to or smaller than a lower-limit threshold, such as 46° C., the controller 14 may increase the heating power of the heater 12 to increase the temperature of the hot airflow and shorten the time for drying hair.

According to the operation method mentioned above, the hair dryer of the present invention can automatically control the heating power of the heater 12, i.e. the temperature of the output hot airflow. Therefore, although the user aims the hair dryer of the present invention at a fixed area, the hair will not be overheated or damaged. Besides, at the initial stage of hair drying, the hair dryer of the present invention outputs an airflow with a higher temperature to blow the hair and thus shortens the time for drying hair.

The temperature variation rate of hair correlates with the moisture of the hair. While the moisture of hair is higher, the temperature variation rate of hair is smaller. In other words, the slope of the temperature rising curve is smaller. While the moisture of hair is lower, the temperature variation rate of hair is larger. In other words, the slope of the temperature rising curve is larger. Therefore, the temperature variation rate of hair may be used to estimate the moisture of hair.

In one embodiment, the hair dryer of the present invention may undertake the hair end-smoothing mode or the hair-maintaining mode. While the user selects the hair end-smoothing mode, the controller 14 regulates the interval between two succeeding measurements to be Δt1. For example, Δt1=2 seconds, and it indicates one measurement per 2 seconds. Thus, measurement is undertaken once per 2 seconds, and the hair temperature variation rate is monitored. While the hair temperature variation rate is equal to or larger than a threshold C1, such as 2.2, the controller 14 controls the hair temperature to rise stably within an appropriate temperature range. While the detected hair temperature reaches the upper-limit threshold T1, such as 48° C., it indicates that the hair wetness index has reached a first preset index M1 of the hair end-smoothing mode. At this moment, the controller 14 may lower the heating power of the heater 12 and increase the rotation speed of the fan 11 to lower the hair temperature to 40° C. Then, the controller 14 reminds the user to stop the operation of the hair dryer. Thus, the hair has a slight amount of moisture, exempted from dryness and dullness.

While the user selects the hair-maintaining mode, the controller 14 regulates the interval between two succeeding measurements to be Δt2. For example, Δt2=0.5 seconds, and it indicates one measurement per 0.5 seconds. Thus, measurement is undertaken once per 0.5 seconds, and the hair temperature variation rate is monitored. While the hair temperature variation rate is equal to or larger than a threshold C2, such as 1.2, the controller 14 controls the hair temperature to rise stably within an appropriate temperature range. While the detected hair temperature reaches the upper-limit threshold T2, such as 45° C., it indicates that the hair wetness index has reached a second preset index M2 of the hair-maintaining mode. At this moment, the controller 14 may lower the heating power of the heater 12 and increase the rotation speed of the fan 11 to lower the hair temperature to 37° C. Then, the controller 14 reminds the user to stop the operation of the hair dryer. Thus, the hair is appropriately moisturized, which favors the user to apply a hair conditioner or a hair essence to his hair. It should be explained: the abovementioned operation modes are only for exemplification; according to requirement, the parameters listed in Table. 1, such as the hair temperature thresholds, the intervals between two succeeding measurements, the hair temperature variation rates, etc., may be varied to create different operation modes for acquiring different levels of hair moisture.

In conclusion, the present invention provides a hair dryer, which uses a non-contact temperature sensor to detect the temperature of hair and determine the dryness of the hair according to at least one of the hair temperature and the hair temperature variation rate, whereby to automatically adjust the temperature or flowrate of the hot airflow, wherefore the hair is exempted from being overheated or damaged and the time for drying hair is shortened.

The embodiments have been described above to demonstrate the technical thoughts and characteristics of the present invention to make the persons skilled in the art to understand, make, and use the present invention. However, these embodiments are not intended to limit the scope of the present invention. Any equivalent modification or variation according to the spirit of the present invention is to be also included by the scope of the present invention.

What is claimed is:

1. A hair dryer comprising:

a fan, generating an airflow to blow hair of a user along an airflow output direction;

a heater, disposed at an airflow output end of the fan and used to heat the airflow generated by the fan;

a temperature sensor, including:

an infrared sensor, pointed to the hair of the user, receiving an infrared light radiated by the hair, and outputting a sensation signal; and a signal processor, electrically connected with the infrared sensor, used to process the sensation signal to acquire a temperature of the hair, determining a dryness of the hair according to at least one of the temperature of the hair and a rate of temperature variation of the hair, and then outputting a corresponding control signal; and a controller, electrically connected with the fan, the heater and the temperature sensor, and controlling at least one of a rotation speed of the fan and a heating power of the heater according to the control signal;

wherein a sensation direction of the temperature sensor is skew to the airflow output direction and intersects with the airflow output direction.

2. The hair dryer according to claim 1, wherein the infrared sensor senses the infrared light having a wavelength of 5-14 μm.

3. The hair dryer according to claim 1, wherein a sensation direction of the temperature sensor is parallel to the airflow output direction.

4. The hair dryer according to claim 1, wherein the temperature sensor is disposed at a geometrical center of an airflow output opening of the hair dryer.

5. The hair dryer according to claim 1, wherein a position where a sensation direction of the temperature sensor intersects with the airflow output direction is 5-20 cm away from an airflow output opening of the hair dryer.

6. The hair dryer according to claim 1, wherein the temperature sensor further includes:

a lens, which is disposed at a receiving side of the infrared sensor and used to limit a viewing angle for receiving the infrared light by the infrared sensor.

7. The hair dryer according to claim 6, wherein the lens is made of a material comprising silicon, germanium, sapphire, or zinc selenide.

8. The hair dryer according to claim 6, wherein the lens is a siliceous Fresnel lens.

9. The hair dryer according to claim 1 further comprising:

a sleeve, wherein the temperature sensor is disposed inside the sleeve.

10. The hair dryer according to claim 9, wherein an inner wall of the sleeve is blackened.

11. The hair dryer according to claim 9, wherein an inner wall of the sleeve is treated with anodizing.

12. The hair dryer according to claim 9, wherein an inner wall of the sleeve has a plurality of ring-shape protrusions.

13. The hair dryer according to claim 9, wherein an inner wall of the sleeve has a screw thread.

* * * * *